United States Patent [19]

Daniels

[11] 4,003,478

[45] Jan. 18, 1977

[54] SHEET TRANSFER MECHANISM

[75] Inventor: Dennis Daniels, Bellevue, Wash.

[73] Assignee: U.S Amada Ltd., City of Industry, Calif.

[22] Filed: Mar. 6, 1975

[21] Appl. No.: 555,831

Related U.S. Application Data

[62] Division of Ser. No. 393,891, Sept. 4, 1973, Pat. No. 3,898,904.

[52] U.S. Cl. ..... 214/1 BB; 83/409; 214/1 BC; 214/1 S; 271/226

[51] Int. Cl.[2] ..... B26D 7/06

[58] Field of Search ..... 83/405, 408, 409, 71, 83/733; 214/1 BC, 1 BB, 1 BH, 1 BT, 151, 1 S, 1 F; 271/114, 115, 228, 241, 242, 267, 268, 180, 80, 226

[56] References Cited

UNITED STATES PATENTS

| | | | |
|---|---|---|---|
| 385,807 | 7/1888 | Huston et al. | 104/47 |
| 2,779,490 | 1/1957 | Clarke et al. | 214/151 X |
| 2,941,499 | 6/1960 | Gutzmer | 214/1 BH X |
| 3,518,908 | 7/1970 | Daniels | 83/409 X |
| 3,603,191 | 9/1971 | Muller et al. | 83/405 |

*Primary Examiner*—Frank E. Werner
*Attorney, Agent, or Firm*—Seed, Berry, Vernon & Baynham

[57] ABSTRACT

A side feeding shearing apparatus is provided with an upper frame having a side opening to allow sheets to be swung between the shear punch and die to position the sheet for feeding past the shear punch. The shear punch is positioned below the sheet supporting surface of the shearing apparatus and is raised for shearing the sheets. Sheets are delivered to the shearing apparatus by a transfer mechanism that includes a base secured to an adjacent N.C. punch press. An arm which clamps the sheet is pivotally mounted on the base and the arm is accurately aligned on the base by a shot pin and corresponding aperture. Movement of the sheet through the shearing apparatus is provided by the sheet positioning means of the N.C. punch press.

3 Claims, 5 Drawing Figures

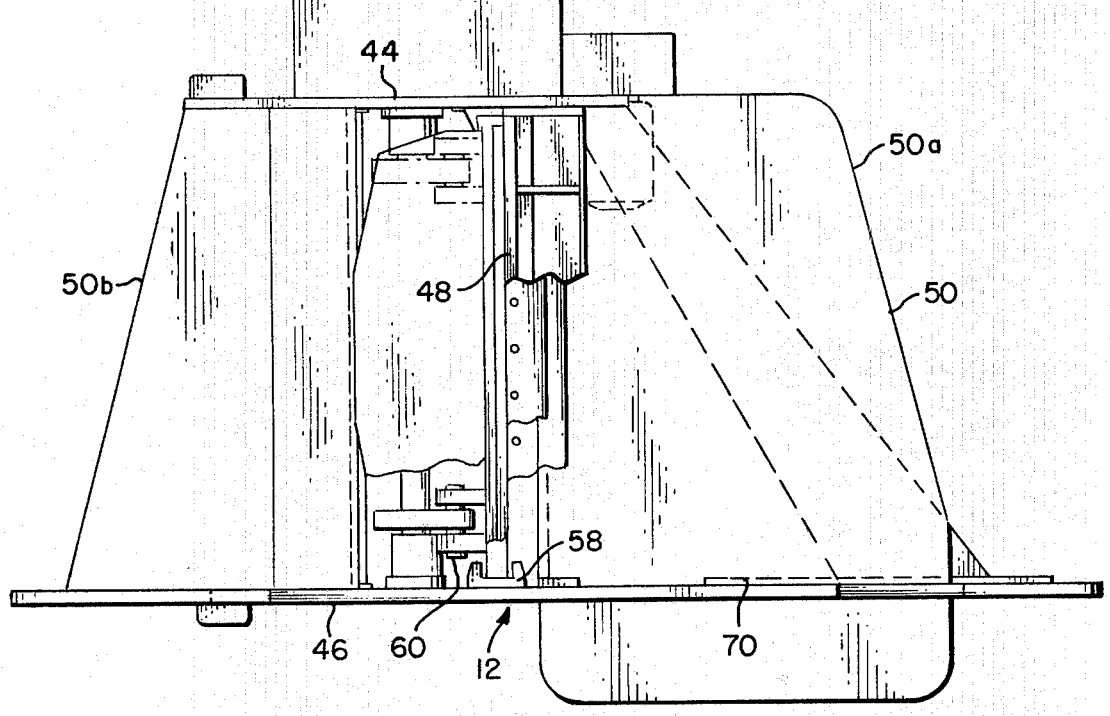
FIG. 2
FIG. 3
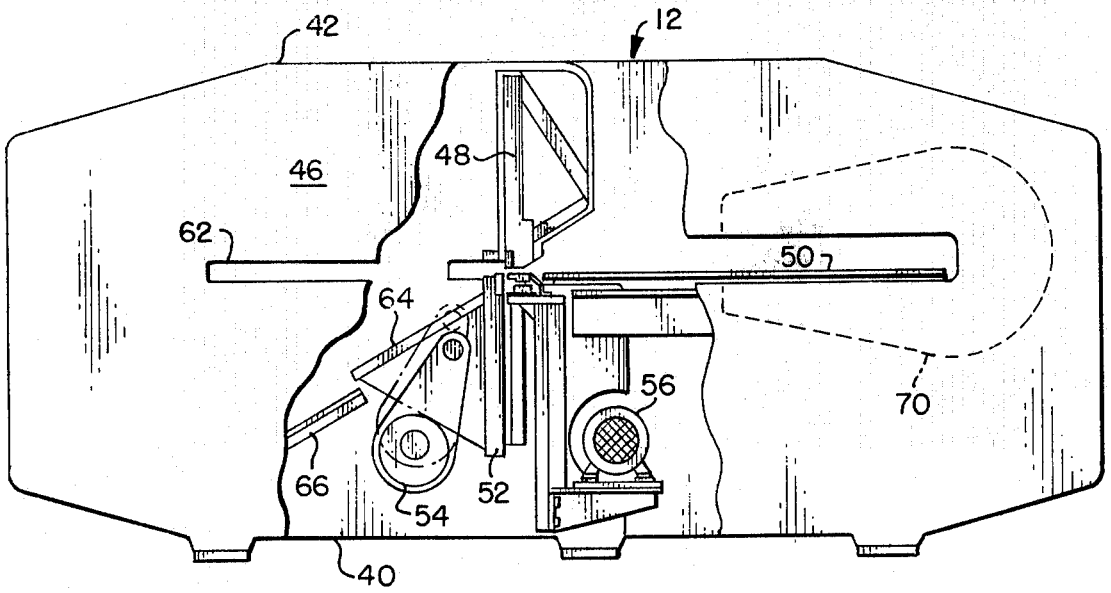

SHEET TRANSFER MECHANISM

This is a division of application Ser. No. 393,891 filed Sept. 4, 1973, now U.S. Pat. No. 3,898,904.

BACKGROUND OF THE INVENTION

1. Field of the Invention

This invention pertains to shearing apparatus for form-sustaining sheet materials and to improved sheet transfer mechanisms for transferring sheets from one machine to an adjacent machine.

2. Description of the Prior Art

Shearing apparatuses have heretofor been fed sheets generally by sliding them laterally or longitudinally onto the forward end of the shearing apparatus upstream from the shear punch. This feature of prior art machines has reduced their effectiveness since transfer of sheets into the apparatus has required time consuming labor intensive operations. Shear punches for these machines have generally been moved downwardly through the sheet to shear the sheet as it is fed between the shear punch and die. In some instances, the motor and drive for the shear punch have been located below the sheet supporting means on the shearing apparatus but in such cases, the shear has still been lowered during its cutting operation.

SUMMARY OF THE INVENTION

It is an object of this invention to provide a shearing apparatus having a side feed opening that allows sheets to be fed laterally past the shear punch and die while positioning the sheet for feeding.

It is another object of this invention to provide a shearing apparatus having an upwardly moved shear punch.

It is another object of this invention to provide a transfer mechanism which can accurately align the sheet relative to the transfer mechanism.

It is another object of this invention to provide a sheet transfer mechanism having an arm pivotally mounted on a base and providing means for accurately aligning the arm relative to the base.

It is still another object of this invention to provide an improved shearing apparatus for use in conjunction with an N.C. punch press.

Basically, the objects for the shearing apparatus are obtained by a unique upper frame mounted on the base of the shearing apparatus. The upper frame is provided with a vertical side frame having a large horizontal opening generally at a right angle to the shear punch and die. Sheets can then be fed laterally into the shearing apparatus through the side opening between the punch and the die. The side opening allows the efffective use of a pivotal type sheet transfer mechanism and is especially useful when handling large size sheets, for example, 50 inches in length and width.

In the preferred embodiment, the shear punch is positioned below the sheet supporting means on the shearing apparatus and is raised for shearing the sheets. Positioning the shearing apparatus and the associated driving mechanism for the shear punch in the lower part of the apparatus reduces the requirement for a large massive upper frame on the shearing apparatus and allows larger sheets to be passed between the shear punch and the die when feeding sheets to the shearing apparatus.

When the shearing apparatus is used in conjunction with the preferred sheet transfer mechanism, the side opening on the shearing apparatus is effective to allow swinging of a sheet by a transfer arm from an adjacent machine. In the preferred form this adjacent machine is a numerically controlled punching apparatus. Accurate alignment is obtained between the transfer arm and the associated base of the transfer mechanism by a shot pin and aperture latch mechanism. The base of the transfer mechanism in the preferred embodiment is a part of the sheet positioning means on the adjacent N.C. punch press so that the sheet can also be accurately fed through the shearing apparatus with the N.C. controls of the punch press.

The sheet transfer mechanism with its accurately aligned transfer arm and base can also be used for transferring and accurately positioning the sheet between any two adjacent machines. That is, a sheet can be passed from one accurate positioning member on one machine to another accurate positioning member of an adjacent machine without losing alignment of the sheet during the transfer operation between the two machines.

BRIEF DESCRIPTION OF THE FIGURES OF THE DRAWING

FIG. 2 is a plan of the shearing apparatus shown in FIG. 1 with parts broken away for clarity.

FIG. 3 is a side elevation of the shearing apparatus shown in FIG. 1 with parts broken away for clarity.

DETAILED DESCRIPTION OF THE PREFERRED EMBODIMENTS

Figure 1:
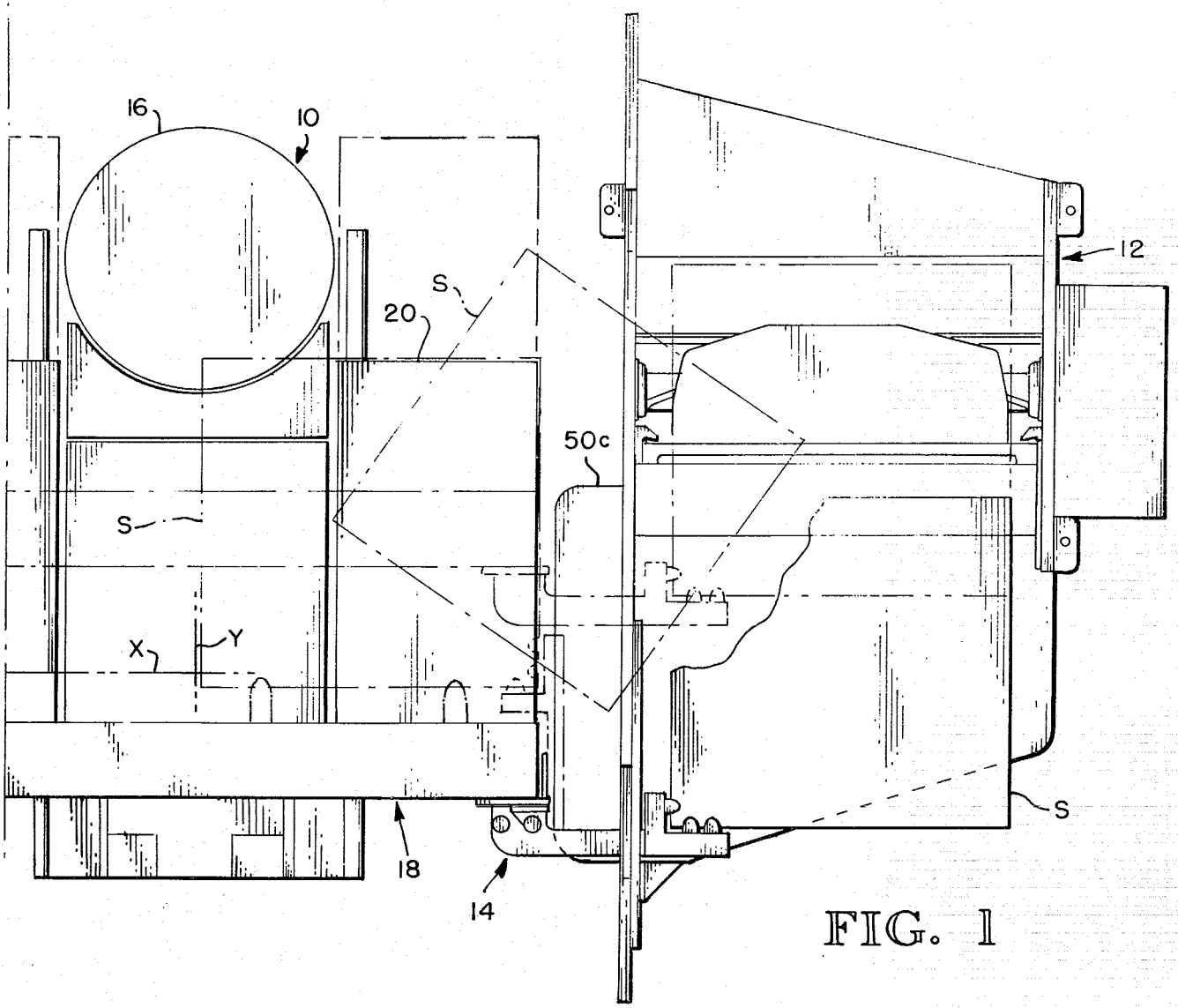
FIG. 1 is a plan view of preferred punching and shearing apparatuses embodying the principles of the invention.
Figure 4:
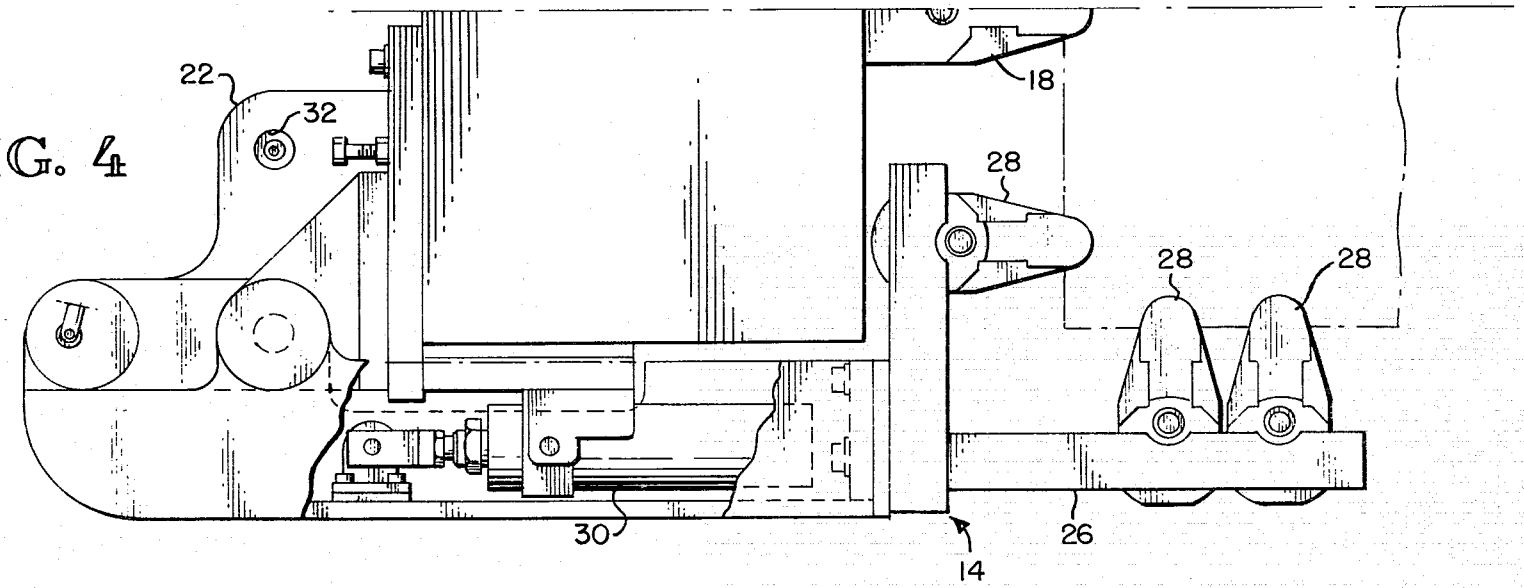
FIG. 4 is a plan view of a preferred form of sheet transfer mechanism with parts broken away for clarity.
Figure 5:
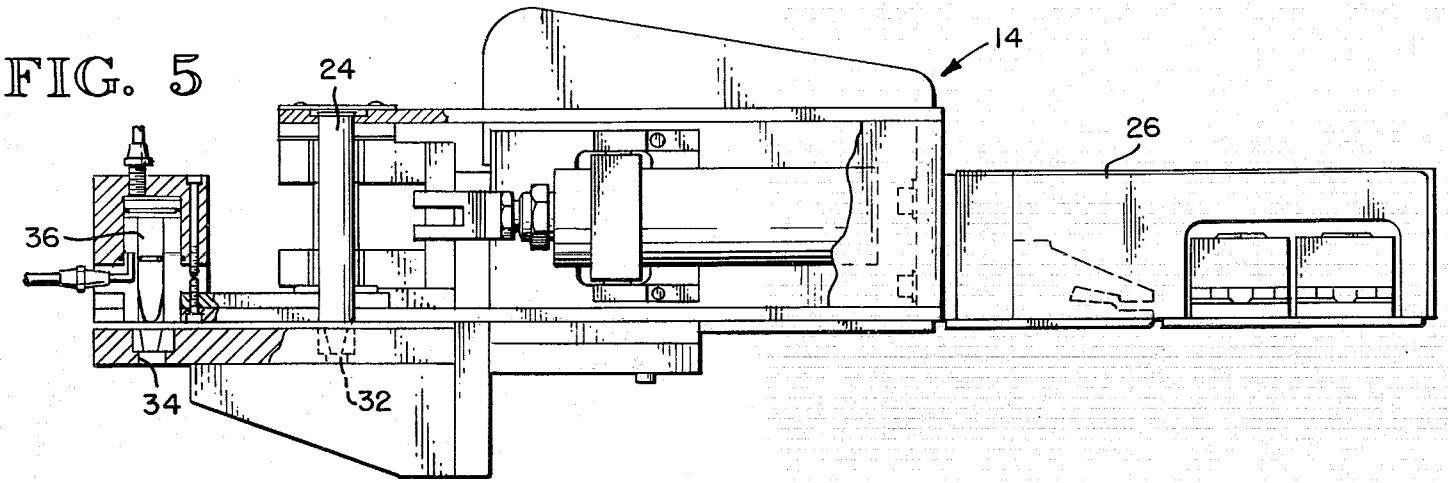
FIG. 5 is a side elevation of the sheet transfer mechanism with parts broken away for clairty.

As best shown in FIG. 1, the principles of the invention are used to best advantage in combined punching and shearing apparatuses or center which includes a punching apparatus 10 positioned closely adjacent a shearing apparatus 12. Preferably, the shearing apparatus is of the numerically controlled type in which a sheet can be automatically positioned beneath a punching turret in both the X and Y axes. Any conventional punching apparatus can be used for this purpose, a preferred type being illustrated in U.S. Pat. No. 3,717,061, the description of which is hereby incorporated by reference thereto. As used throughout this specification, the term numerically controlled is intended to means programmed automatically controlled or manually remotely controlled machines well known in the art. The sheets are of the type that are self form-sustaining such as metal, plastic, wood or the like. Sheets are transferred between the punching apparatus and the shearing apparatus by a sheet transfer mechanism 14. The transfer mechanism is basically of the type illustrated in my U.S. Pat. No. 3,815,403, the description of which is specifically incorporated by reference thereto. The transfer mechanism is most advantageously used in this application in conjunction with the numerical controls of the punch press to both transfer sheets between the punching apparatus and the shearing apparatus as well as to feed the sheet through the shearing operation. It should be understood, of The upper frame is provided with two vertical side frames 44 and 46. The upper frame supports a die 48 which extends transversely across the upper frame 42. The die is positioned above a sheet supporting table or surface 50 having a forward or inlet end 50a and a rearward or discharge end 50b. Positioned below the die 48 is a movable shear punch 52 that is reciprocated vertically across the die by an eccentric drive 54 powered by a motor 56. The shear punch rides in guides 58 and is pinned to the eccentric by pins 60. As is readily apparent, rotation of the eccentric 54 reciprocates the arm on said base in said first position so that the sheet can be accurately engaged relative to the first machine and for accurately locating the transfer arm in said second location on said base and relative to said second machine so that the sheet can be accurately located on the second machine when carried to the second machine, said first machine including numerically controlled sheet positioning means for reciprocably positioning a sheet on said first machine in the Y axis and said base being connected to said reciprocable sheet positioning means at a location adjacent said second

15

20

25

30

35

40

45

50

55

60

65